US008689750B2

(12) United States Patent
Genise

(10) Patent No.: US 8,689,750 B2
(45) Date of Patent: Apr. 8, 2014

(54) CAMSHAFT PHASING DEVICE

(75) Inventor: David Gerard Genise, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 115 days.

(21) Appl. No.: 13/372,971

(22) Filed: Feb. 14, 2012

(65) Prior Publication Data

US 2013/0206086 A1 Aug. 15, 2013

(51) Int. Cl.
*F01L 1/02* (2006.01)

(52) U.S. Cl.
USPC ..... 123/90.31; 123/90.15; 123/90.17; 464/160

(58) Field of Classification Search
USPC ..... 123/90.31, 90.15, 90.17; 464/160
See application file for complete search history.

(56) References Cited

U.S. PATENT DOCUMENTS

| | | | |
|---|---|---|---|
| 5,979,383 | A | 11/1999 | Faville et al. |
| 6,019,076 | A | 2/2000 | Pierik et al. |
| 6,360,705 | B1 | 3/2002 | Raghavan et al. |
| 6,688,267 | B1 | 2/2004 | Raghavan |
| 6,769,387 | B2 | 8/2004 | Hayman et al. |
| 6,782,855 | B1 | 8/2004 | Albertson et al. |
| 7,007,649 | B2 | 3/2006 | Raghavan et al. |
| 7,162,983 | B1 | 1/2007 | Raghavan et al. |
| 7,225,776 | B2 | 6/2007 | Gecim et al. |
| 8,327,815 | B2 * | 12/2012 | Hale et al. ..... 123/90.17 |

FOREIGN PATENT DOCUMENTS

| | | | |
|---|---|---|---|
| DE | 3842251 | A | 6/1990 |
| DE | 19702670 | A | 3/1998 |
| DE | 19801679 | A | 7/1999 |
| DE | 10242596 | A | 3/2004 |
| DE | 102007017897 | A | 10/2008 |
| EP | 0143368 | A | 6/1985 |
| JP | S5374605 | A | 7/1978 |
| JP | 4505546 | B1 * | 7/2010 |
| WO | 2011070895 | A | 6/2011 |

OTHER PUBLICATIONS

International Search Report and Written Opinion for PCT/US2013/025718 dated Jul. 9, 2013.

* cited by examiner

*Primary Examiner* — Ching Chang
(74) *Attorney, Agent, or Firm* — Remarck Law Group PLC

(57) ABSTRACT

A camshaft phase adjustment device comprises a housing receiving a camshaft. A driving gear member has a first gear and a camshaft receiving portion. The driving gear member transfers motion from the driveshaft to the first gear, which is meshed with a second gear. A second and third gear are mounted on an axle parallel to the camshaft. The second gear and third gear rotate with the same angular velocity. The third gear transfers motion to a fourth gear. The fourth gear is coupled to the camshaft for transferring angular motion to the camshaft such that the camshaft rotates with the angular velocity of the fourth gear. An actuator rotates the housing about the axis of the camshaft.

20 Claims, 4 Drawing Sheets

CAMSHAFT PHASING DEVICE

FIELD OF THE INVENTION

This application is directed to camshaft phasing devices for internal combustion engines.

BACKGROUND

Operation of internal combustion engines involves control of the timing of the opening and closing of engine valve. This timing is dictated by the relationships between, for example, the driveshaft, the camshaft, the rocker arm and the engine valve. In a typical case, the angular position of the driveshaft dictates the angular position of the camshaft, and therefore of the cams. The position of the cams, in turn, dictates the position of the valves.

SUMMARY

In one aspect of the present teachings, a camshaft phase adjustment device comprises a housing having a first flange and a second flange each having an opening for receiving a camshaft. A driving gear member has a first gear placed between the first and second flange and a camshaft receiving portion that extends through the opening of the first flange. The driving gear member also has a driveshaft coupling portion that receives the drive chain, resulting in motion from the driveshaft being transferred to the first gear. The driving gear member has a passage configured to receive the camshaft and allow free rotation of the camshaft relative to the driving gear member. A second and third gear are mounted on an axle secured to the housing parallel to the camshaft. The second gear is coupled to the third gear so that the third gear rotates with the same angular velocity as the second gear. The third gear transfers motion to a fourth gear. The fourth gear is coupled to the camshaft for transferring angular motion to the camshaft such that the camshaft rotates with the angular velocity of the fourth gear. The teeth of the second gear are meshed with the teeth of the first gear and the teeth of the third gear are meshed with the teeth of the fourth gear. An actuator is coupled to the housing for rotating the housing about the axis of the camshaft.

In another aspect of the present teachings, a camshaft phase adjustment device comprises a frame having a first passage and a second passage. The first passage is configured to receive a camshaft and permit rotational motion of the frame about the camshaft. A driving gear member having a first gear and a camshaft receiving portion is coupled to the driveshaft for transferring rotational motion from the driveshaft to the first gear. The driving gear member has a passage extending through the first gear and the camshaft receiving portion through which the camshaft is placed. The second passage is configured to receive an axle on which a second and third gear are mounted. The second and third gear are mounted to the axle such that the third gear rotates with the angular velocity of the second gear. The teeth of the second gear are meshed with the teeth of the first gear and the teeth of the third gear are meshed with the teeth of a fourth gear that is coupled to the camshaft. The fourth gear transfers angular motion to the camshaft. The camshaft rotates with the angular velocity of the fourth gear.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 2:
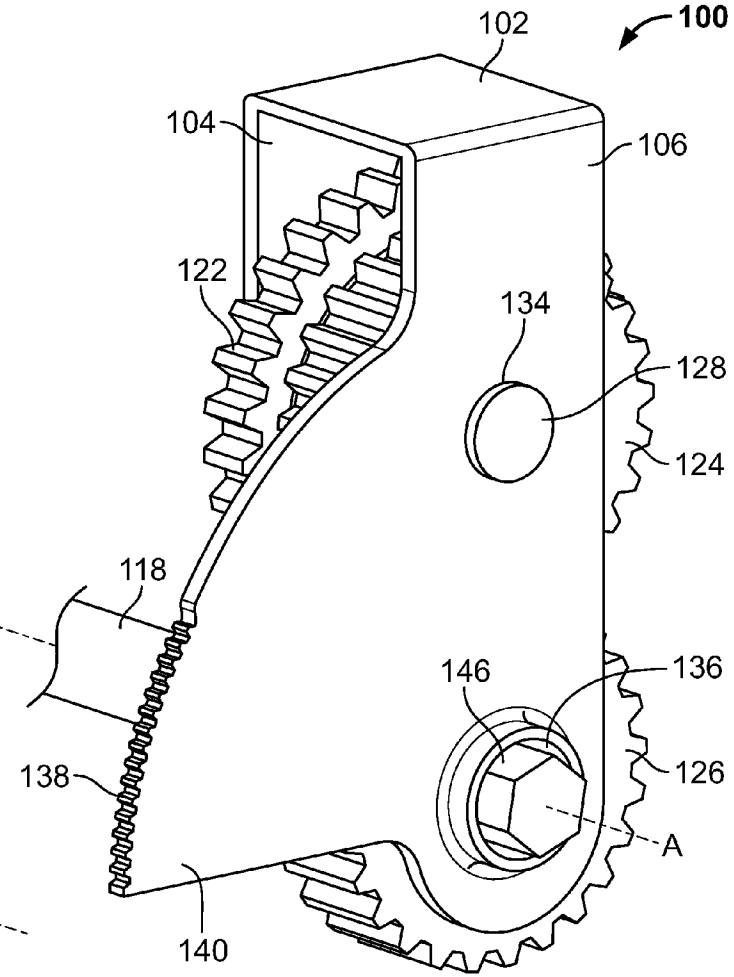
FIGS. 1 and 2 illustrate perspective views of an exemplary phasing device 100.

Certain terminology will be used in the following description for convenience in describing the figures will not be limiting. The terms "upward," "downward," and other directional terms used herein will be understood to have their normal meanings and will refer to those directions as the drawing figures are normally viewed.

Figure 1:
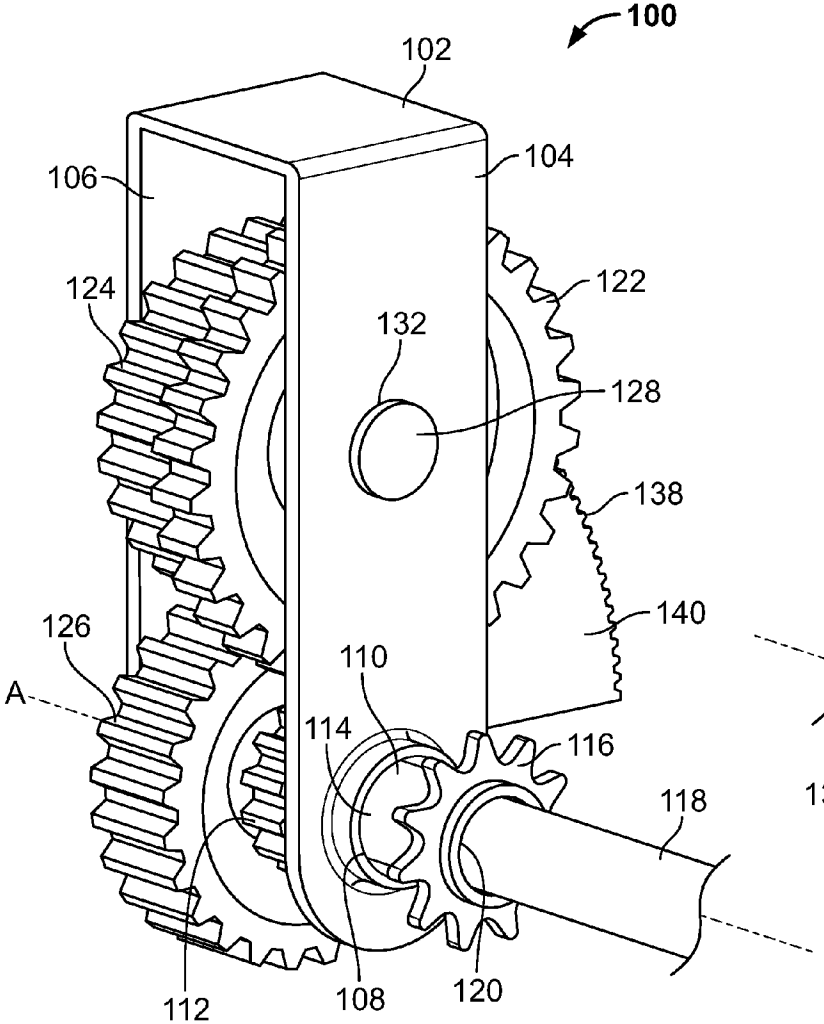

FIGS. 1 and 2 illustrate perspective views of an exemplary phasing device 100. Phasing device 100 is shown by way of example only and it will be appreciated that the configuration of phasing device 100 that is the subject of this disclosure is not limited to the configuration of phasing device 100 illustrated in the figures herein.

As shown in FIG. 1, phasing device 100 includes a housing 102 having a first flange 104 and second flange 106. First flange 104 has a first opening 108 that receives a driving gear member 110. Driving gear member 110 has a first gear 112 disposed between first flange 104 and second flange 106. Driving gear member 110 has a hollow camshaft receiving portion 114 that extends the length of driving gear member 110, from first gear 112, through first opening 108 of first flange 104. As shown in FIG. 1, driving gear member 110 has a driveshaft coupling sprocket 116 disposed on the opposite side of first flange 104 relative to first gear 112. Driveshaft coupling sprocket 116 is configured to receive a driveshaft or crankshaft chain (not shown) that is meshed with a sprocket located on the driveshaft or crankshaft (not shown). In such an arrangement, the motion of the driveshaft is transferred to driving gear member 110 and in particular to first gear 112. It should be noted that mechanisms other than sprockets and chains may be used to transfer motion from the driveshaft to driving gear member 110. For example, a belt-driven system may be implemented in accordance with the present disclosure. Camshaft 118 is inserted through a passage 120 in driving gear member 110. Passage 120 extends through driving gear member 110, allowing camshaft 118 to extend through driving gear member 110. Passage 120 of driving gear member 110, camshaft 118, first opening 108 and camshaft receiving portion 114 all have circular cross-sections. This configuration allows camshaft 118 to rotate freely with respect to driving gear member 110 and also allows driving gear member 110 to rotate freely with respect to housing 102.

Thus, camshaft 118, driving gear member 110 and housing 102 are all free to rotate with respect to one another about the axis of camshaft 118.

Figure 3:
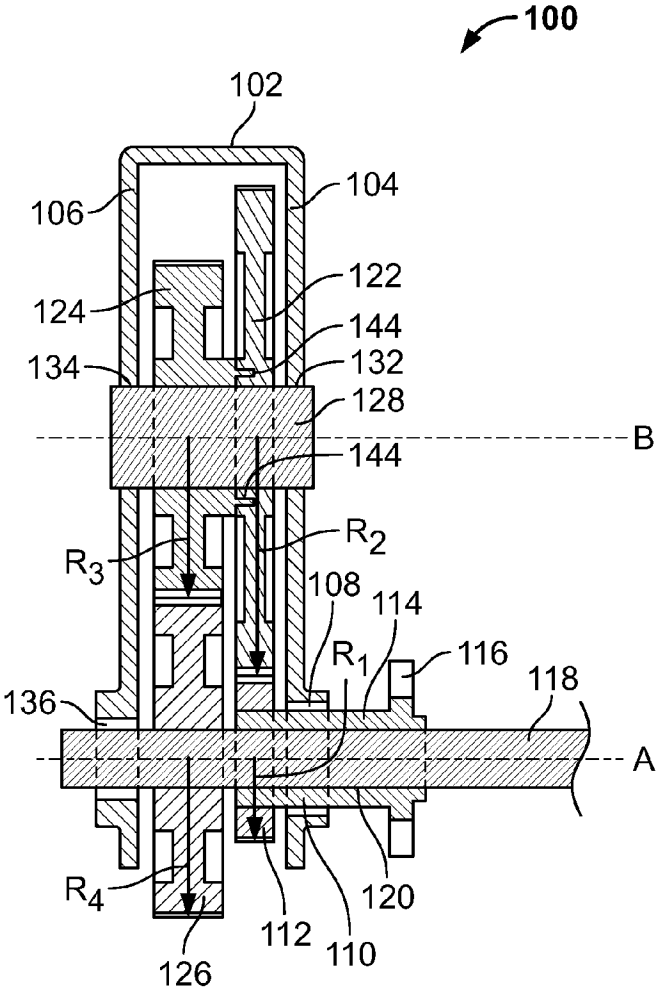
FIG. 3 illustrates a cross-sectional side view of exemplary phasing device 100 shown in FIG. 1.

With reference to FIGS. 1 and 3, a second gear 122, third gear 124 and fourth gear 126 are disposed within housing 102. The teeth of first gear 112 are meshed with the teeth of second gear 122. Second gear 122 and third gear 124 rotate about longitudinal axis B of axle 128, which is parallel to longitudinal axis A of camshaft 118. Axle 128 is secured to housing 102 at a first axle opening 132 located on first flange 104 and a corresponding second axle opening 134 located on second flange 106 as seen in FIG. 2. Thus, axis B is maintained at a constant distance from axis A. Second gear 122 and third gear 124 are secured to one another by means of pins 144 extending from gear 124 into corresponding recesses in gear 122 (shown in FIG. 3), which means ensure second gear 122 and third gear 124 rotate with the same angular velocity. Axle 128 may be rotatably or non-rotatably secured to housing 102, so long as second gear 122 and third gear 124 are permitted to rotate freely about axis B of axle 128. In one such example, axle 128 may be secured to housing 102 such that is does not rotate with respect to housing 102, while second gear 122 and third gear 124 are secured directly to one another as shown in FIG. 3 so that second gear 122 and third gear 124 rotate about axle 128 with the same angular velocity.

Thus, in the configuration shown in FIG. 3, when driven by the driveshaft chain (not shown) that is engaged with both the driveshaft (not shown) and the driveshaft coupling sprocket 116, driving gear member 110 rotates relative to camshaft 118 and housing 102 at a rotational speed dictated by the rotational movement of the driveshaft. The rotational motion of driving gear member 110 rotates first gear 112. Because the teeth of second gear 122 are meshed with the teeth of first gear 112, first gear 112 imparts rotational motion to second gear 122. Second gear 122 and third gear 124 are configured to rotate with the same angular velocity, and therefore rotational motion of second gear 122 is imparted to third gear 124. The teeth of third gear 124 are meshed with the teeth of fourth gear 126, thereby imparting rotational motion to fourth gear 126. Fourth gear 126 is coupled to the camshaft 118 such that camshaft 118 and fourth gear 126 rotate with the same angular velocity. Thus, rotational motion introduced to driving gear member 110 by the driveshaft chain is imparted to camshaft 118. The gears illustrated in the accompanying figures are non-planetary spur gears. However, other gear types may be implemented according to the present disclosure. For example, helical gears arranged in a parallel configuration may be used.

As shown in FIG. 3, in one aspect of the present teachings, radius $R_1$ of first gear 112 is smaller than radius $R_2$ of second gear 114, the radii in FIG. 3 being measured from the axis of rotation of the particular gear to the pitch circle of the gear. Radius $R_2$ of second gear 122 is also larger than radius $R_3$ of third gear 124. The radii $R_3$, $R_4$ of third gear 124 and fourth gear 126 are the same. In other aspects of the present teachings, the gears may be arranged with various sizes. For example, radius $R_3$ of third gear 124 may be smaller or larger than radius $R_4$ of fourth gear 126. In other examples, radius $R_1$ of first gear 112 may be the same as or larger than radius $R_2$ of second gear 122. The sizes of the gears may be selected such that torque is either stepped up, or stepped down relative to toque provided by a driveshaft. In the general case, assuming that the gears are non-slipping, the torque T imparted to camshaft 118 upon introduction of a torque $T_c$ at the driveshaft coupling sprocket 116 by the driveshaft is given by the following relationship:

$$T = \frac{R_2}{R_1}\frac{R_4}{R_3}T_C.$$

As shown in FIG. 2, camshaft 118 extends through second flange 106 through second opening 136. As with first opening 108, second opening 136 has a circular cross-section, allowing camshaft 118 to rotate freely with respect to housing 102. A rack 138 located on arcuate wing 140 of second flange 106 allows for an associated pinion gear (not shown) to engage the teeth of rack 138. By rotating such a pinion gear engaged with the teeth of rack 138, the pinion gear rotates phasing device 100 about camshaft 118. Other mechanisms may used to rotate phasing device 100 with respect to camshaft 118. In other aspects of the present teachings, a hinge mechanism located on wing 140 and connected to a hydraulic piston serves as an actuator and rotates phasing device 100 about camshaft 118.

By rotating phasing device 100 about camshaft 118, a change in the phase of camshaft 118 is achieved. The position and angular velocity of driving gear member 110, which is rotatably mounted to housing 102, are dictated by the motion of the driveshaft, which is transmitted to driving gear member 110 by the drive chain. Another feature of this configuration is that the position and angular velocity of driving gear member 110 and first gear 112 are independent of the rotation of phasing device 100 about camshaft 118. Thus, rotating phasing device 100 about camshaft 118 in the counterclockwise direction by an angle Φ (while the driveshaft is held motionless), measured with reference to the bottom edge of wing 140 shown in FIG. 4, imparts the same amount of rotational motion to camshaft 118 as rotating first gear 112, or driving gear member 110, in the clockwise direction by the same angle Φ (while housing 102 is held motionless). In both cases, rotational motion is imparted to second gear 122, and by the same mechanism described above, through third gear 124 and fourth gear 126 and ultimately to camshaft 118. Thus, in one aspect of the present teachings, a shift in the phase of camshaft 118 can be imparted independently of the motion of the driveshaft by rotating housing 102 by the desired amount in the desired direction.

Figure 4:
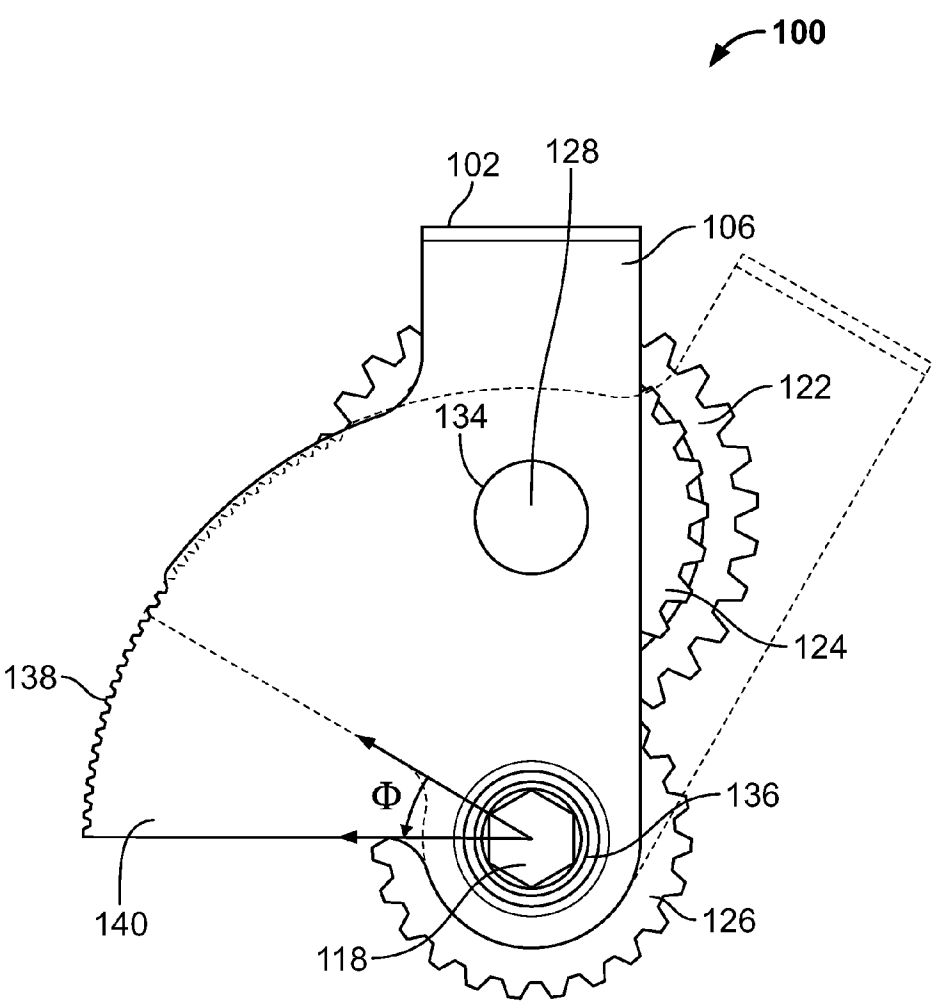
FIG. 4 illustrates a front view of exemplary phasing device 100 shown in FIG. 1.

With reference to FIG. 4, during normal operation the drive chain rotates driving gear member 110 in the counterclockwise direction, and thus first gear 112 also rotates in the counterclockwise direction. This imparts clockwise motion in second gear 122. Third gear 124, which has the same angular motion as second gear 122, thus also moves in the clockwise direction. Third gear 124 imparts a counterclockwise rotation onto fourth gear 126, and likewise to camshaft 118. By rotating phasing device 100 in the clockwise direction, for example, rotational movement is imparted to second gear 122 in addition to the motion imparted to second gear 122 by first gear 112. The result of the clockwise rotation of phasing device 100 about longitudinal axis A of camshaft 118 is an additional rotational motion, or phase shift, imparted to camshaft 118 in addition to rotational motion imparted to camshaft 118 by the drive chain and subsequent transfer of that motion through driving gear member 110, second gear 122, third gear 124 and fourth gear 126.

Figure 5:
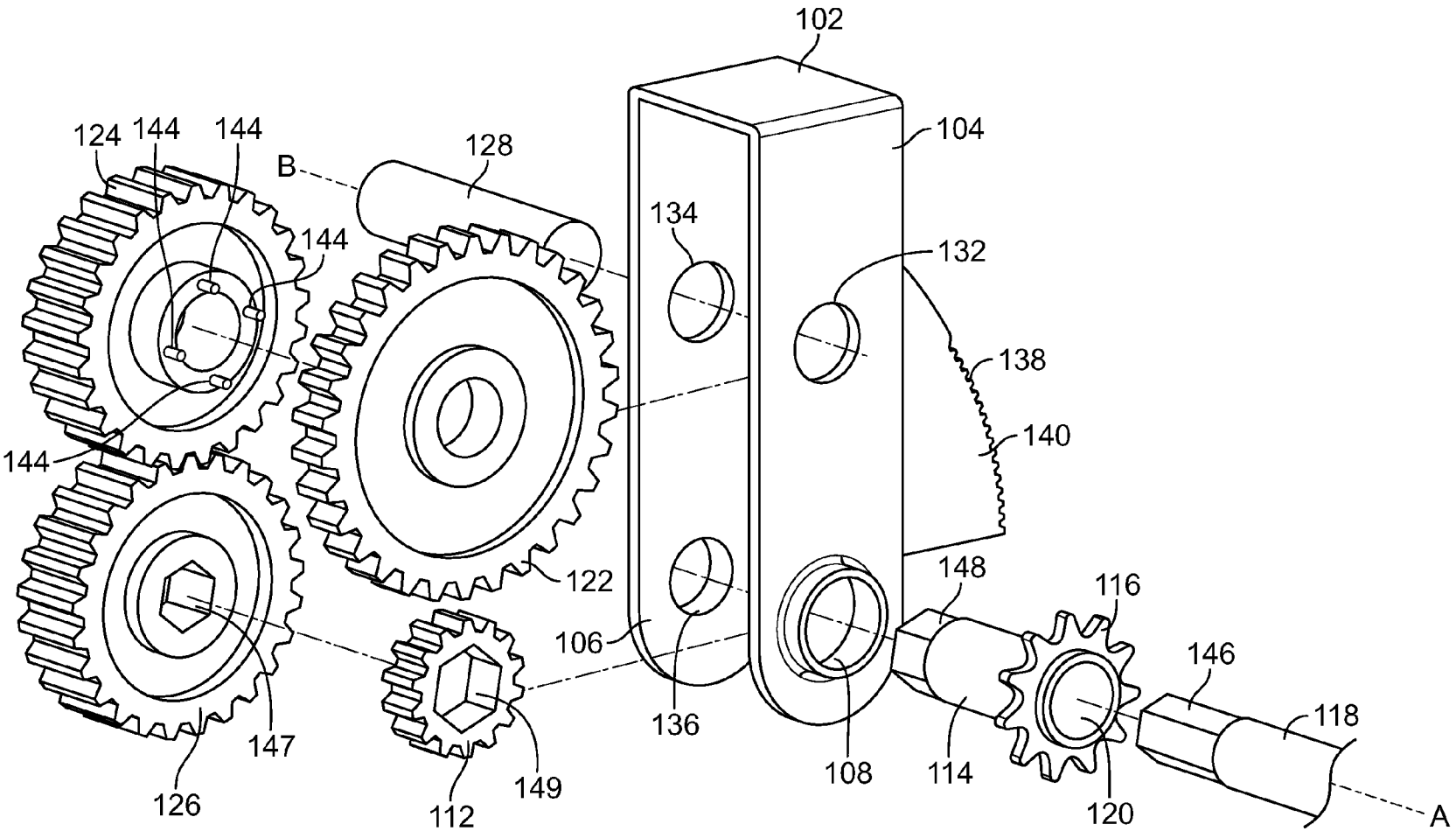
FIG. 5 illustrates an exploded view of exemplary phasing device 100 shown in FIG. 1.

FIG. 5 illustrates an exploded view of phasing device 100 shown in FIGS. 1-4. As shown in FIG. 5, second gear 122 has pins 144 that are inserted into third gear 124 upon assembly, thereby ensuring that, once assembled, second gear 122 and third gear 124 rotate with the same angular velocity. Driving gear member 110 is shown in two pieces, one piece comprising driveshaft coupling sprocket 116 and camshaft receiving portion 114 and second piece comprising first gear 112. This configuration allows camshaft receiving portion 114 to be inserted through circular first opening 108, which allows first gear 112 to be secured to camshaft receiving portion 114 while between first flange 104 and second flange 106. A hexagonal interface 148 is inserted into a complementary hexagonal hole 149 of first gear 112. Hexagonal interface 148 and hexagonal hole 149 are sized to give a secure fit, thereby ensuring driveshaft coupling sprocket 116 and first gear 112 rotate with the same angular velocity. Fourth gear 126 is secured to camshaft 118 in a similar manner. A second hexagonal interface 146 located at the end of camshaft 118 is inserted into a second hexagonal hole 147 of forth gear 126. Hexagonal hole 147 is sized to provide a secure fit, thereby ensuring fourth gear 126 rotates with the same angular velocity as camshaft 118.

Figure 7:
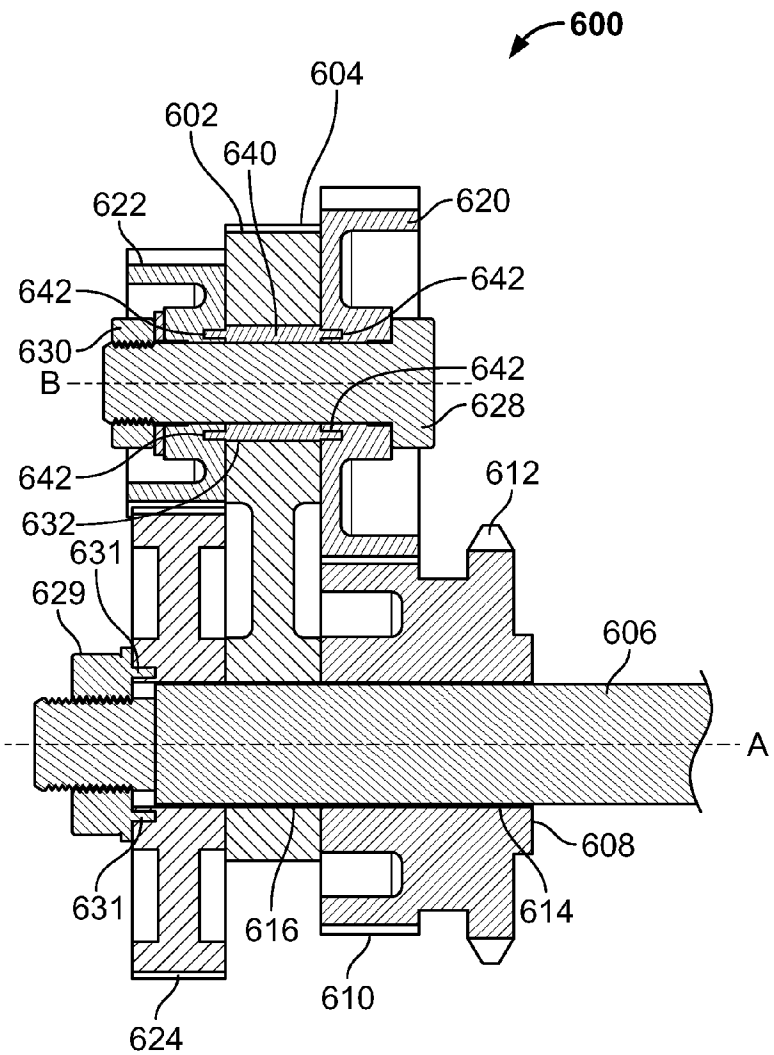
FIG. 7 illustrates a cross-sectional side view of exemplary phasing device 600 shown in FIG. 6.
Figure 6:
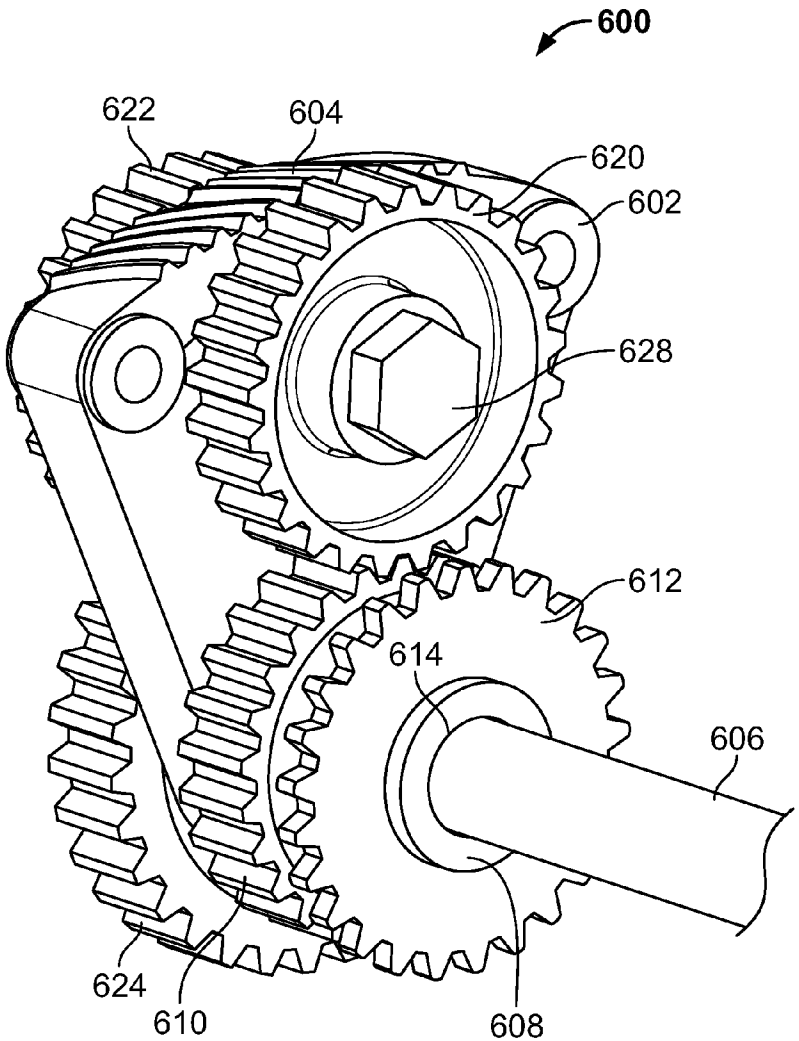
FIG. 6 illustrates a perspective view of an exemplary phasing device 600.

FIGS. 6 and 7 illustrate a perspective view and a cross-sectional side view, respectively, of an alternative cam phasing device 600. In this cam phasing device 600, a carrier or frame 602 has a rack 604 that is configured to be coupled to an actuator in the form of a pinion gear (not shown) that is able to rotate cam phasing device 600 about the longitudinal axis A of camshaft 606. As shown in FIG. 7, a driving gear member 608 comprises a first gear 610 and a driveshaft coupling portion 612 in the form of a sprocket that engages a drive chain (not shown). Driving gear member 608 is configured to rotate freely with respect to camshaft 606 and frame 602. Camshaft 606 extends through a passage 614 in driving gear member 608 and through a first frame opening 616, and rotates freely with respect to driving gear member 608 and frame 602. A fourth gear 624 is mounted to camshaft 606 by a nut 629 having pins 631 that are inserted into fourth gear when assembled such that fourth gear 624 and camshaft 606 rotate with the same angular velocity.

With continued reference to FIG. 7, first gear 610 is meshed with second gear 620. First gear 610 thereby imparts rotational motion to second gear 620 when first gear 610 rotates. Second gear 620 and third gear 622 rotate about axis B, which is parallel to and spaced a constant distance from axis A. Second gear 620 and third gear 622 are secured to sleeve 640, which has pins 642 extending into second gear 620 and third gear 622, ensuring second gear 620 and third gear 622 rotate about axis B with the same angular velocity. Sleeve 640 is configured to rotate freely in frame opening 632. Second gear 620 and third gear 622 are secured to sleeve 640 with threaded bolt 628 that extends through sleeve passage 632 and nut 630. Third gear 622 is meshed with fourth gear 624, third gear 622 thereby imparting rotational motion to fourth gear 624. Fourth gear 624 imparts rotational motion to camshaft 606, which rotates at the same angular velocity as fourth gear 624.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A camshaft phase adjustment device, comprising:

a housing having a first flange having a first opening and a second flange having a second opening, wherein a camshaft is received by the housing and extends through both of the first and second openings, the camshaft including a first end having cams and a second terminal end, the second terminal end received by the second opening;

a driving gear member having a first gear disposed between the first and the second flange, a camshaft receiving portion extending from the first gear through the first opening of the first flange and a driveshaft coupling portion positioned on a common side of the housing as the first end of the camshaft, the driveshaft coupling portion configured to transfer rotational motion from the driveshaft to the first gear, and a passage extending through the camshaft receiving portion wherein the camshaft is received through the passage permitting rotation of the camshaft relative to the driving gear member;

a second gear and a third gear disposed between the first and the second flange and mounted on an axle secured to the housing and having a longitudinal axis, the longitudinal axis of the axle parallel to a longitudinal axis of the camshaft, the second gear coupled to the third gear such that the third gear rotates with the angular velocity of the second gear, and wherein the teeth of the second gear are meshed with the teeth of the first gear and the teeth of the third gear are meshed with the teeth of a fourth gear;

the fourth gear coupled to the camshaft for transferring angular motion of the fourth gear to the camshaft such that the camshaft will rotate with the angular velocity of the fourth gear; and wherein the housing is configured to be coupled to an actuator for rotating the housing about the longitudinal axis of the camshaft.

2. The device of claim 1, wherein the housing comprises a rack configured to receive the actuator, the actuator comprising a pinion gear.

3. The device of claim 2, wherein at least one of the first and the second flanges comprises an integrally formed arcuate wing, the arcuate wing comprising the rack, wherein the integrally formed arcuate wing extends only along a common plane as the at least one of the first and second flanges.

4. The device of claim 1, wherein the actuator is a hydraulic actuator rotatably coupled to the housing by a hinge at one end of the actuator.

5. The device of claim 1, wherein the second gear has a radius larger than a radius of the third gear.

6. The device of claim 1, wherein the second gear has a radius larger than a radius of the first gear.

7. The device of claim 1, wherein the second gear has a radius larger than a radius of the first gear and a radius of the third gear.

8. A camshaft phase adjustment device, comprising:

a frame having a first flange that defines a first passage and a second flange that defines a second passage, the first and second passages configured to receive a camshaft and permit rotational motion of the frame about the camshaft;

a driving gear member having a first gear and a camshaft receiving portion coupled to the driveshaft for transferring rotational motion from the driveshaft to the first gear, the driving gear member having a passage extending through the camshaft receiving portion, wherein the driving gear member passage receives the camshaft therethrough to allow rotation of the camshaft relative to the driving gear member; and a second gear and a third gear mounted on an axle extending through the second frame passage, the axle having a longitudinal axis parallel to a longitudinal axis of the camshaft, the second and the third gear mounted to the axle such that the third gear rotates with the angular velocity of the second gear, and wherein the teeth of the second gear are meshed with the teeth of the first gear and the teeth of the third gear are meshed with the teeth of a fourth gear;

wherein the fourth gear is coupled to the camshaft for transferring angular motion to the camshaft such that the camshaft rotates with the angular velocity of the fourth gear.

9. The device of claim 8, wherein the frame comprises an actuator receiving portion.

10. The device of claim 9, wherein the actuator receiving portion comprises a rack configured to receive a pinion gear.

11. The device of claim 8, wherein the actuator receiving portion is configured to pivotably receive one end of the actuator.

12. The device of claim 8, wherein the second gear has a radius larger than a radius of the third gear.

13. The device of claim 8, wherein the second gear has a radius larger than a radius of the first gear.

14. The device of claim 8, wherein the second gear has a radius larger than a radius of the first gear and a radius of the third gear.

15. A camshaft phase adjustment device, comprising:

a housing having a first flange and a second flange substantially parallel to the first flange, the first and the second flange each having a camshaft opening and an axle opening, wherein a camshaft is received by the camshaft openings of the first and second flanges, the camshaft including a first end having cams and a second terminal end, the second terminal end received by the second opening;

a driving gear member having a first gear disposed between the first and the second flange, a sprocket for coupling to a driveshaft, the sprocket being positioned on a common side of the housing as the first end of the camshaft, and a camshaft receiving portion extending through the camshaft opening of the first flange and between the first gear and the sprocket, the driving gear member having a passage that rotatably receives the camshaft, and wherein the driving gear member allows rotation of the housing relative to the driving gear member about a longitudinal axis of the camshaft; and a second gear and a third gear disposed between the first and second flange and mounted on an axle having a longitudinal axis and mounted to the housing, the axis of the axle parallel to the axis of the camshaft, the second gear coupled to the third gear such that the third gear rotates with the angular velocity of the second gear, and wherein the teeth of the second gear are meshed with the teeth of the first gear and the teeth of the third gear are meshed with the teeth of a fourth gear;

wherein the fourth gear is coupled to the camshaft for transferring angular motion to the camshaft such that the camshaft rotates with the angular velocity of the fourth gear; and wherein the housing includes an actuator receiving portion configured to receive an actuator.

16. The device of claim 15, wherein the actuator receiving portion comprises a rack.

17. The device of claim 15, wherein at least one of the first and the second flanges comprises an integrally formed arcuate wing, the arcuate wing comprising the rack, wherein the integrally formed arcuate wing extends only along a common plane as the at least one of the first and second flanges.

18. The device of claim 15, wherein the actuator receiving portion is configured to pivotably receive one end of the actuator.

19. The device of claim 15, wherein the second gear has a radius larger than a radius of the third gear.

20. The device of claim 15, wherein the second gear has a radius larger than a radius of the first gear.

* * * * *